US008344649B2

(12) United States Patent
Siessegger et al.

(10) Patent No.: US 8,344,649 B2
(45) Date of Patent: Jan. 1, 2013

(54) UNIVERSAL ELECTRONIC BALLAST FOR OPERATING HG-FREE LAMPS AND HG-CONTAINING DISCHARGE LAMPS

(75) Inventors: Bernhard Siessegger, Munich (DE); Guenther Hirschmann, Munich (DE)

(73) Assignee: OSRAM Gesellschaft mit beschraenkter Haftung, Munich (DE)

( * ) Notice: Subject to any disclaimer, the term of this patent is extended or adjusted under 35 U.S.C. 154(b) by 508 days.

(21) Appl. No.: 12/527,558

(22) PCT Filed: Feb. 12, 2008

(86) PCT No.: PCT/EP2008/051663

§ 371 (c)(1),
(2), (4) Date: Aug. 18, 2009

(87) PCT Pub. No.: WO2008/101836

PCT Pub. Date: Aug. 28, 2008

(65) Prior Publication Data

US 2010/0033107 A1 Feb. 11, 2010

(30) Foreign Application Priority Data

Feb. 19, 2007 (DE) ..... 10 2007 008 148

(51) Int. Cl.
*H05B 41/36* (2006.01)

(52) U.S. Cl. ..... 315/291; 315/308

(58) Field of Classification Search ..... 315/209 R, 315/224, 291, 307, 308
See application file for complete search history.

(56) References Cited

U.S. PATENT DOCUMENTS 5,600,211 A * 2/1997 Luger ..... 315/307
6,525,479 B1 2/2003 Keggenhoff et al.
6,765,355 B2 7/2004 Matsumoto et al.
2003/0160578 A1 8/2003 Matsumoto et al.
2007/0268151 A1 11/2007 Juen et al.

FOREIGN PATENT DOCUMENTS

DE 19850441 A1 5/2000
DE 102004008806 A1 9/2005
DE 102004061294 A1 6/2006
EP 0759686 A2 2/1997
EP 0702508 B1 2/2000
WO 2005060320 A1 6/2005

OTHER PUBLICATIONS

International Search Report of PCT/EP2008/051663 mailed Jun. 30, 2008.
English abstract of EP 075968 A2, Feb. 26, 2007.
Wahrig, German Dictionary, 7th Edition, Bertelsmann Lexikon Verlag GmbH, Munich, 2000, p. 394, word: Einmalig.
Wahrig, German Dictionary, 7th Edition, Bertelsmann Lexikon Verlag GmbH, Munich, 2000, p. 244, word: Beeinflussen.
Leuchtunittelmarkt.com, Product: Osram SOX 18 BY22d 18W Niederdrucklampe, http://www.leuchtmittelmarkt.com//themes/kategorie/detail.php?artikelid=182731&source=2, printed on Nov. 22, 2011. www.derenergiesparladen.de, Product: Osram Powerstar HQI-T, http://www.derenergiesparladen.de/produkt.php?lang=de&pm_id=1682&cat1_name=Hochdruck-Entladungslampen&cat2_name=Quecksilberdampf-Hochdrucklampen, printed on Nov. 17, 2011.
English Abstract of EP1566989. (Corresponding to DE10200400806. Sep. 8, 2005.).

* cited by examiner

*Primary Examiner* — Don Le

(57) ABSTRACT

An electronic ballast for a discharge lamp includes a microcontroller, which is configured to identify the parameters which determine the discharge lamp type. The microcontroller implements an orientation mode program once when the lamp is first switched on, which orientation mode program can be used to determine the type of discharge lamp.

24 Claims, 1 Drawing Sheet

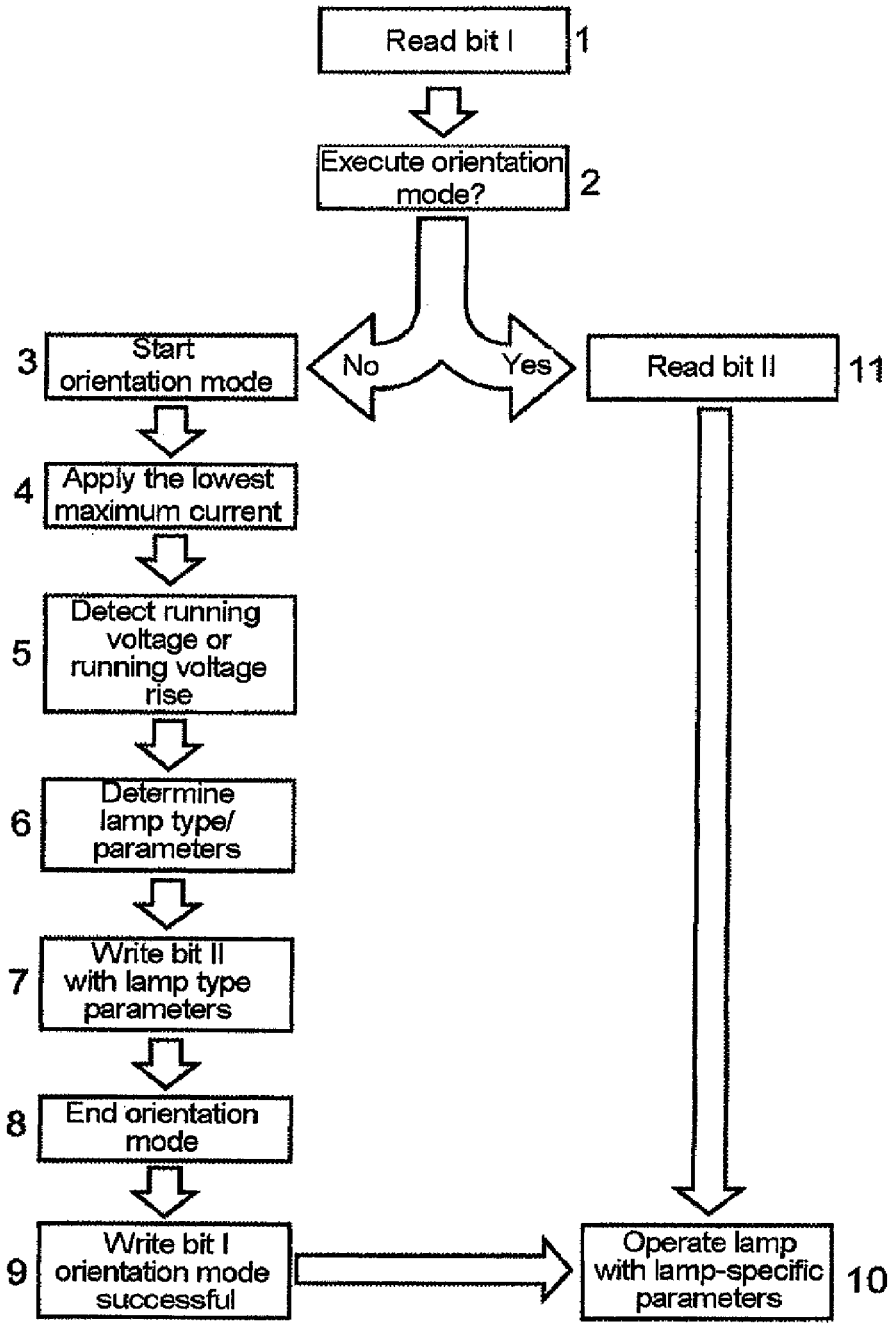
Read bit I
1
Execute orientation mode?
2
No
Yes
3
Start orientation mode
4
Apply the lowest maximum current
5
Detect running voltage or running voltage rise
6
Determine lamp type/ parameters
7
Write bit II with lamp type parameters
8
End orientation mode
9
Write bit I orientation mode successful
Read bit II
11
Operate lamp with lamp-specific parameters
10

UNIVERSAL ELECTRONIC BALLAST FOR OPERATING HG-FREE LAMPS AND HG-CONTAINING DISCHARGE LAMPS

RELATED APPLICATIONS

The present application is a national stage entry according to 35 U.S.C. §371 of PCT application No.: PCT/EP2008/051663 filed on Feb. 12, 2008, which claims priority from German application No.: 10 2007 008 148.2 filed on Feb. 19, 2007.

TECHNICAL FIELD

The present invention relates to a method for driving a discharge lamp by means of an electronic ballast and to an electronic ballast with which any desired types of discharge lamps can be operated.

BACKGROUND

Mercury-containing and mercury-free lamps, in particular discharge lamps for use in motor vehicles (so-called D lamps), each have very different properties. This applies in particular to the electrical properties of the two lamp types, which demonstrate the same rated power of 35 watts during steady-state operation, but the mercury-free lamp only has approximately half the running voltage in comparison with the mercury-containing lamp. Even during startup, the two lamp types need to be operated very differently than one another in order to achieve the desired requirements, such as sufficiently high instantaneous luminous flux alongside an acceptable life.

Therefore, a dedicated electronic ballast type is used in the prior art for each lamp type (Hg-containing D1 lamp and Hg-free D3 lamp), the respective electronic ballast type individually taking into consideration the particular features of the associated lamp type. Although the two electronic ballast types are based on a common hardware and software concept, the detailed requirements of the lamps do not make it possible to exchange the electronic ballasts for one another.

This results in the disadvantage that, during production, it is necessary to distinguish between two hardware and two software variants and then two products need to be managed both in terms of sales and by the customer, which firstly means twice the storage requirement and secondly often results in confusion.

In order to reduce the possibility of confusion, it has been proposed in the prior art to use different plug codings. However, this has the result that different cables are also required in addition to the different electronic ballasts and lamps.

The patent application EP 0 759 686 A2 has proposed a method and a circuit arrangement in which the electronic ballast has a microprocessor which identifies the individual lamp type connected to the electronic ballast and drives the lamp depending on the lamp type specification identified.

For this purpose, the lamp-type-specific codings arranged on the lamp, such as knobs arranged on the lamp base, for example, which owing to their number and arrangement form a lamp-type-specific coding, are detected and the lamp is driven correspondingly to previously stored operational parameters for this lamp type. Another possibility of lamp type identification consists in detecting a bar code applied to the lamp. Furthermore, there is the possibility of additionally using electrical variables for lamp type identification.

One disadvantage with this prior art, however, is the fact that each time the lamp is switched on there is a delay while the electronic ballast determines the lamp type in question. Therefore, this procedure is unsuitable precisely for application in motor vehicles since in this case it is necessary for the lamp to be started up particularly quickly. This is also the reason why the lamp power is increased to a multiple of the rated power during startup (so-called power startup).

SUMMARY

The object of the present invention is therefore to provide a method and an electronic ballast which can be used universally for discharge lamps, but makes possible direct driving of the discharge lamps.

This object is achieved by a method for operating a discharge lamp by means of an electronic ballast, in which the parameters which determine the type of discharge lamp are ascertained in an orientation mode step, which is implemented once when the discharge lamp is first brought into operation, and by an electronic ballast for a discharge lamp with a microcontroller, which is configured to implement an orientation mode program once when the lamp is first switched on, which program can be used to identify the parameters which determine the type of discharge lamp.

The parameters established during the orientation mode are stored and the lamp is operated with these stored operational parameters every time it is started again. This has the advantage that, firstly, the lamp parameters can be ascertained very precisely during the orientation phase, and secondly there is no longer a delay when the lamp is switched on since, once an orientation mode has been concluded, the lamp is now only operated with the operational parameters identified in the orientation mode.

During the orientation mode, the lamp is advantageously operated with the lowest of the permissible lamp currents. This ensures that there is no damage to the lamp as a result of the currents or powers being selected so as to be too high.

Particularly preferred is an exemplary embodiment in which a sensor element detects the running voltage or a running voltage rise of a lamp fitted on the electronic ballast and, on the basis of the identified values, which are characteristic of the lamp type, the lamp type is determined. This is particularly advantageous since the running voltage or running voltage rise are values which can be identified easily, and other type identification features, such as bar codes or knobs fitted on the lamp, as are known from the prior art, for example, do not need to be used.

Particularly advantageous is an exemplary embodiment in which the electronic ballast according to the invention includes a microcontroller, which is configured to drive a lamp connected to the electronic ballast in such a way that the lamp is operated once in an orientation mode when it is first switched on, during which orientation mode the lamp type is identified, and each time the lamp is switched on again, the lamp is operated in a normal operating mode which is matched to the lamp.

This avoids delays brought about by an enquiry being made in each case regarding the lamp type prior to the lamp actually being brought into operation, as is known from the prior art.

It is furthermore advantageous if the electronic ballast includes a memory element in which at least one first bit for indicating whether an orientation mode has been implemented and one second bit for indicating the lamp type are stored. By reading the memory, the microcontroller can immediately decide whether an orientation mode still needs to be implemented or whether the lamp can be brought into operation immediately.

Furthermore, an exemplary embodiment is particularly advantageous in which the electronic ballast additionally has a communications interface, in particular an LIN bus. By means of this communications interface, for example, it is possible to carry out a check to ascertain whether a lamp type has been correctly identified. Furthermore, it is possible for the electronic ballast to be reprogrammed, for example by the first bit being deleted, by means of this interface in the event of a change of lamp type. If this first bit is deleted, the microcontroller of the electronic ballast once again implements the orientation mode, as a result of which the new lamp can be identified. This has the significant advantage that, when there is a change in lamp type, it is not necessary for the electronic ballast and the lamp to be replaced, but only the lamp itself.

It is particularly advantageous to use the method according to the invention and the electronic ballast according to the invention in headlamps for the operation of mercury-free (Hg-free) or mercury-containing (Hg-containing) metal-haloid high-pressure discharge lamps for application in motor vehicles, so-called D lamps. Although Hg-free and Hg-containing lamps are based on a common hardware or software concept, until now it has only been possible for them to be operated with different electronic ballasts owing to the very different electrical properties. Secondly, the universal electronic ballast according to the invention makes it possible for the electronic ballasts to remain in the automobile while only the lamp is replaced, as a result of which switching from Hg-containing to Hg-free can be carried out very quickly and very easily.

Further advantages and advantageous exemplary embodiments are defined in the dependent claims, the FIGURE and the description.

BRIEF DESCRIPTION OF THE DRAWING

The invention will be described below with reference to a drawing. In this case, the drawing merely shows an exemplary embodiment which should not be used for restricting the scope of the invention to the example illustrated.

The single FIGURE shows a flowchart of a first particularly preferred exemplary embodiment of the method according to the invention.

DETAILED DESCRIPTION

In principle, the operation of Hg-containing and Hg-free D lamps by means of a single type of electronic ballast is made possible without any conversion in terms of hardware or software or any intervention in the electronic ballast by virtue of the fact that the hardware is dimensioned correspondingly and intelligent software is used. The hardware should in this case be dimensioned substantially with respect to the Hg-free lamp since this type of lamp requires the higher current. The intelligence of the software consists in the fact that the operational parameters for both lamps are stored in the software and when the electronic ballast/lamp combination is first switched on, the lamp is operated once in a so-called orientation mode, the lamp type present being identified and being stored in a memory element. Then and every other time the lamp is started, the lamp is operated with the determined and matched operational parameters. In this case, the first switch-on operation and the operation in the orientation mode can advantageously take place only on the headlamp manufacturer's premises in a first function test of the headlamp system. Advantageously, two bits are stored in a memory element in the electronic ballast, which bits firstly indicate whether an orientation mode has been executed and secondly determine which operational parameters should be used for operating a lamp.

FIG. 1 correspondingly shows a flowchart of the method according to the invention which can be executed, by way of example, by a mirocontroller contained in an electronic ballast in order to operate a discharge lamp in accordance with the invention.

In a first step 1, the microcontroller accesses a memory element arranged in the electronic ballast in order to read a bit I stored in the memory element. The bit I indicates whether an orientation mode has been executed (step 2).

If no orientation mode has as yet been executed, this is tantamount to the lamp having been brought into operation for the first time, and, in a further step 3, the microcontroller starts an orientation mode program, during which the lamp type connected to the electronic ballast is intended to be identified and the identified lamp type parameters are stored in such a way that they are directly accessible each time the lamp is restarted.

Since it has not yet been established in the orientation mode which lamp is present, no power startup of the lamp can take place since the lamp could otherwise be damaged. Instead, in a step 4, a lamp current is applied to the lamp, said lamp current having been limited to the lowest of the permissible maximum lamp currents. This means, for example, that when using Hg-free or Hg-containing D lamps, the maximum current is limited to that of the Hg-containing lamp, since a much higher current is permissible for the Hg-free lamp. In addition, the startup power and the rated power are restricted to the lowest of all the permissible values. In the case of the Hg-containing and Hg-free D lamp, the rated power is identical to 35 W, but a higher power is associated with the Hg-free lamp during the startup phase (startup power). The limitation of currents and powers explained reliably prevents damage to the lamp during the orientation mode.

In a step 5, a running voltage or a running voltage rise of the lamp is then detected, for example, by means of a sensor element arranged in the electronic ballast. On the basis of this parameter and the development of this parameter over time after starting of the lamp, it is possible, for example, to decide upon the lamp type in question. However, it is also conceivable to detect other parameters determining the lamp type instead of the steps described in steps 4 and 5.

It is critical that a method is implemented in steps 4 and 5 which makes it possible to identify the lamp type and to identify the associated operational parameters in order to make it possible to determine the lamp type and therefore the lamp operational parameters in the subsequent step 6.

The operational parameters specifying the lamp type which are determined in step 6 can be stored, for example, in a further step 7 via a bit II being written to the memory element. If there are not only two lamp types to choose from, in method step 7 it is also possible for one byte to be written instead of one bit, with this byte indicating the lamp type. By means of the bit or byte stored in step 7, the microntroller can decide which operational parameters should be read from the memory element, and which are then used to drive the lamp. Possible memory types are nonvolatile memories, for example EEPROM or flash memories. EPROM memories are also conceivable, but the functional scope is correspondingly restricted owing to the lack of rewriteability. An EEPROM memory is assumed in the following text.

After the writing of bit II, the orientation mode is ended (step 8), with the bit I being changed in a step 9 in such a way that it indicates that an orientation mode has been executed successfully. This can take place, for example, by virtue of the fact that the bit I is transferred from a state "0" to a state "1". If the orientation mode has been concluded successfully, the microcontroller reads the lamp-specific parameters defined by the bit/byte II from the memory and, in a step 10, drives the lamp in such a way that the lamp is operated with the lamp-specific parameters. This means, for example, if it has been identified during the orientation mode that the lamp connected is an Hg-free D lamp, the rated current and the startup current and the startup power are increased correspondingly.

Each time the lamp is subsequently started, the microcontroller now establishes in step 2 that an orientation mode has been executed, whereupon it can directly read the bit/byte II and operate the lamp correspondingly (step 11/step 10).

If it was not possible for there to be unique assignment to one of the lamp types under consideration during the orientation phase, different scenarios are possible. In the simplest case, the lamp is switched off and the fault becomes obvious. Alternatively, the lamp can be operated in a "blinking" mode, for which purpose the power of the lamp is periodically changed between the rated power and, for example, 80% of the rated power. It is likewise conceivable for the orientation mode to be repeated cyclically until the orientation mode has been implemented successfully. For this purpose, after each orientation mode the lamp is switched off for a certain period of time, for example 5 minutes, in order then to perform a renewed attempt. In all of the scenarios outlined, the bit I is only changed when successful identification of the lamp type has taken place.

If final function tests still need to be carried out in the manufacture of the electronic ballast after programming of the microcontroller, in this case the orientation mode should not yet be implemented. Therefore, a meter needs to be provided in the microcontroller which stores the number of switch-on operations. Only once this meter has reached a predetermined value is the orientation mode started. The lamp type which is used as a basis for the operation of the lamp prior to the implementation of the orientation mode is determined in the microcontroller using a further bit or byte during programming.

In order to be able to influence the bit I stored in the memory element, for example in order to not have to replace the entire electronic ballast in the event of a change to the lamp type or in order to check which lamp type has been determined, the electronic ballast advantageously has a communications interface. This can be implemented, for example, by an LIN bus. This communications interface makes it possible for example to delete the bit I, or to reset to the "orientation mode not executed" state. By means of the communications interface, however, it is not only possible to access the bit I, but also to change the bit/byte II or to store further operational parameters for discharge lamps in the memory element of the electronic ballast. As a result, even in the case of newly developed lamps, the old electronic ballasts can continue to be used, which allows for very inexpensive conversion to new lamps.

The previously described embodiment is particularly advantageous for electronic ballasts which are switched on and off by their supply voltage being switched. For electronic ballasts which are permanently connected to the supply voltage and are switched into the active operating state, for example, by an additional control line or communications interface, a particularly simple method for influencing the bit I stored in the memory element is possible:

This influencing takes place by virtue of complete zero-voltage switching of the electronic ballast, for example by the plug which supplies the supply voltage to the electronic ballast being withdrawn for a short period of time. Volatile memories, for example RAM memories, can now also be used as types of memories. After the zero-voltage switching, either the bit I can already be deleted so that execution of the orientation mode is initiated. However, it is also possible for the microcontroller to start a program in the event of a voltage loss after reestablishment of the voltage, which program brings about complete deletion of the stored bits and subsequently restarts the orientation mode, with the result that the bits I and II can be influenced in this way too.

The invention discloses a method and an electronic ballast which can be used universally for a plurality of types of discharge lamps and which implements an orientation mode, for the purpose of identifying the lamp type, once when the lamp is first switched on, during which orientation mode the lamp type is identified.

The invention claimed is:

1. A method for operating a discharge lamp by means of an electronic ballast, the method comprising: identifying parameters which determine the type of discharge lamp during operation of the lamp by the electronic ballast, wherein the identifying the discharge lamp type is performed once when the lamp is first brought into operation in an orientation mode following a predetermined number of switch-on operations.

2. The method as claimed in claim 1, further comprising: storing in the electronic ballast whether or not an orientation mode has been passed through.

3. The method as claimed in claim 1, further comprising: establishing for the discharge lamp type using at least one of a measurable running voltage and a running voltage rise.

4. The method as claimed in claim 1, further comprising: in the orientation mode, operating the lamp at least one of the lowest of the permissible maximum lamp currents and the lowest maximum power.

5. The method as claimed in claim 1, further comprising: storing the parameters for the operation of the discharge lamp in the electronic ballast.

6. The method as claimed in claim 1, wherein the method is used for distinguishing between Hg-containing and Hg-free discharge lamps.

7. The method as claimed in claim 1, further comprising storing a default lamp type in said electronic ballast.

8. The method as claimed in claim 7, further comprising operating a discharge lamp connected to the electronic ballast according to said default lamp type on every switch-on operation preceding the predetermined number of switch-on operations.

9. The method as claimed in claim 1, further comprising storing a number of switch-on operations.

10. The method as claimed in claim 1, further comprising storing the lamp type in a memory element in such a way that, each time the lamp is switched on again, said lamp is operated with the parameters which were established in the orientation mode; and influencing the stored values via a communication interface arranged in the ballast in such a way that that a first bit of the memory element for indicating execution of the orientation mode is deleted or reset to an orientation-mode-not-executed state and a further bit or byte of the memory element for indicating the lamp type is changed for the purpose of changing the lamp types to be identified an operated by the electronic ballast.

11. An electronic ballast for a discharge lamp, the electronic ballast comprising: a microcontroller, which is configured to identify parameters which determine the discharge lamp type, wherein the microcontroller implements an orientation mode program once when the lamp is first switched on following a predetermined number of switch-on operations, which orientation mode program can be used to determine the type of discharge lamp.

12. The electronic ballast as claimed in claim 11, wherein the electronic ballast is furthermore configured to operate at least one of Hg-containing and Hg-free lamps.

13. The electronic ballast as claimed in claim 12, wherein the electronic ballast is configured to operate $H_g$-free discharge lamps.

14. The electronic ballast as claimed in claim 11, further comprising: an apparatus for supplying a supply voltage to the electronic ballast, which supply voltage can be used for zero-voltage switching of the electronic ballast.

15. The electronic ballast as claimed in claim 14, wherein the apparatus is furthermore configured to influence the bits stored in the memory element by virtue of complete zero-voltage switching of the electronic ballast.

16. The electronic ballast as claimed in claim 11, further comprising: a sensor element configured to establish at least one of a running voltage and a running voltage rise of the discharge lamp.

17. The electronic ballast as claimed in claim 16, wherein the microcontroller is furthermore configured to identify the type of discharge lamp on the basis of at least one of a running voltage established by the sensor and a running voltage rise.

18. The electronic ballast as claimed in claim 11, wherein the electronic ballast is further configured to drive the discharge lamp in the orientation mode with at least one of the lowest of the permissible maximum lamp currents and the lowest maximum power.

19. The electronic ballast as claimed in claim 11, further comprising:

a memory element configured to store at least one first bit for indicating the execution of an orientation mode and one second bit or byte for indicating the lamp type; and a communications interface configured to read the first bit and the second bit or byte stored in the memory element and to delete or reset the first bit to an orientation-mode-not-executed state and to change the second bit or byte for the purpose of changing the lamp types to be identified and operated by the electronic ballast.

20. The electronic ballast as claimed in claim 19, wherein the memory element is configured to store the bit during the orientation mode.

21. The electronic ballast as claimed in claim 19, wherein the memory element is a read/write memory.

22. The electronic ballast as claimed in claim 19, wherein the microcontroller is configured to read the bits from the memory and to operate the discharge lamp with the parameters determined by the second bit if the first bit indicates that the orientation mode has been executed.

23. The electronic ballast as claimed in claim 19, wherein the communications interface is configured as an LIN bus.

24. The electronic ballast as claimed in claim 19, wherein the communications interface is configured to at least one of overwrite and delete the bits stored in the memory element.

* * * * *